US008602528B2

(12) United States Patent
Tominaga et al.

(10) Patent No.: US 8,602,528 B2
(45) Date of Patent: Dec. 10, 2013

(54) PRESSURE DAMPER, LIQUID JET HEAD, AND LIQUID JET APPARATUS

(75) Inventors: Kazuyoshi Tominaga, Chiba (JP); Takanori Koyano, Chiba (JP); Jun Kawamura, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 13/362,543

(22) Filed: Jan. 31, 2012

(65) Prior Publication Data

US 2012/0200637 A1 Aug. 9, 2012

(30) Foreign Application Priority Data

Feb. 7, 2011 (JP) ..... 2011-024234
Nov. 10, 2011 (JP) ..... 2011-246669

(51) Int. Cl.
*B41J 2/135* (2006.01)

(52) U.S. Cl.
USPC ..... 347/44

(58) Field of Classification Search
USPC ..... 347/44, 67, 20
See application file for complete search history.

(56) References Cited

U.S. PATENT DOCUMENTS

| | | | | |
|---|---|---|---|---|
| 4,673,955 | A | 6/1987 | Ameyama et al. | 346/140 |
| 5,078,455 | A | 1/1992 | Washington | 303/69 |
| 6,817,707 | B1 * | 11/2004 | Fowler et al. | 347/86 |
| 6,880,910 | B2 * | 4/2005 | Tominaga | 347/20 |
| 2004/0027427 | A1 | 2/2004 | Tominaga | 347/85 |
| 2004/0051767 | A1 | 3/2004 | Takano | 347/94 |
| 2005/0151801 | A1 | 7/2005 | Neese et al. | 347/85 |
| 2010/0245481 | A1 | 9/2010 | Okubo | 347/50 |

FOREIGN PATENT DOCUMENTS

| | | |
|---|---|---|
| EP | 1285761 | 2/2003 |
| EP | 1707365 | 10/2006 |
| EP | 1839881 | 10/2007 |
| GB | 2348259 | 9/2008 |
| JP | 2009137263 | 6/2009 |
| WO | 2007098524 | 9/2007 |

* cited by examiner

*Primary Examiner* — Matthew Luu
*Assistant Examiner* — Michael Konczal
(74) *Attorney, Agent, or Firm* — Adams & Wilks

(57) ABSTRACT

A pressure damper includes a main body portion and a flexible film mounted on the main body portion. The main body portion has upper end portion, a recessed portion having an opening portion opened in the upper end portion, and a communication port opened in an inner surface of the recessed portion to communicate with an outer region of the pressure damper. The upper end portion forms at least one bank that surrounds the opening portion. The at least one bank has a height larger than a height of an upper surface of the main body portion and a width smaller than a width of a side wall of the main body portion. The flexible film is bonded to an upper surface of the bank to close the opening portion.

18 Claims, 9 Drawing Sheets

PRESSURE DAMPER, LIQUID JET HEAD, AND LIQUID JET APPARATUS

BACKGROUND OF THE INVENTION

1. Field of the Invention

The present invention relates to a pressure damper for alleviating pressure fluctuation of fluid, and more particularly, to a pressure damper in which a bonding strength between a flexible film and a main body portion is improved, and to a liquid jet head and a liquid jet apparatus that use the pressure damper.

2. Description of the Related Art

In recent years, there has been used an ink jet type liquid jet head which ejects ink droplets onto recording paper and the like to draw letters and diagrams, or ejects a liquid material onto a surface of an element substrate to form a functional thin film. The liquid jet head of this type is supplied with ink or a liquid material from a liquid tank via a supply tube, and is caused to eject the ink or the liquid material filled in channels thereof from nozzles communicated to the channels. At the time of ink ejection, the liquid jet head and a recording medium for recording the jetted liquid are moved, to thereby record the letters and diagrams or form the functional thin film in a predetermined shape. In an apparatus of this type, it is necessary to control an ejection amount and an ejection speed with high accuracy when the liquid droplets are ejected from the nozzles. The ejection amount and the ejection speed are affected by an ink pressure of the nozzles, and hence in order to fix the ink pressure, a pressure damper is provided in an ink flow path.

For example, Japanese Patent Application Laid-open No. 2009-137263 describes a damper for fixing the pressure of the ink to be ejected from a printing head. FIG. 9 is an exploded perspective view of the damper (FIG. 3 of Japanese Patent Application Laid-open No. 2009-137263). The damper includes a damper base body 120 having a recessed portion for storing ink formed therein, a flexible film portion 122 for closing an opening of the recessed portion, and a damper cover 121 provided above the film portion 122, for preventing breakage of the film portion 122. Ink flows in from an ink supply path 104 in a direction of "a", and flows out toward a flow path member of a recording head in a direction of "b". Inside the recessed portion, there are provided a movable plate 123 and a spring 124 provided between the movable plate 123 and the damper base body 120 (see FIG. 10).

Ink is filled in a region surrounded by the recessed portion of the damper base body 120 and the film portion 122. When pressure fluctuation is generated in the filled ink, or when pressure fluctuation is transmitted to the filled ink via the ink supply path 104, the film portion 122 is displaced in the vertical direction to alleviate the pressure fluctuation of the filled ink. With this, the pressure fluctuation is not transmitted to the ink flowing out in the direction of "b". That is, the damper causes the ink that has been subjected to pressure fluctuation alleviation to flow out in the direction of "b".

Generally, the damper base body 120 and the film portion 122 are made of a synthetic resin. The damper base body 120 is formed by molding of the synthetic resin, and the film portion 122 is bonded to an upper end portion of the damper base body 120 by thermal welding. Ink is filled into the recessed portion of the damper base body 120. Further, pressure fluctuation is applied to the ink filled inside. Therefore, the upper end portion of the damper base body 120 is required to be bonded to the film portion 122 with good sealing property and firmly so as to prevent ink leakage and prevent peeling of the film portion 122 even when the internal pressure of the ink greatly increases.

FIG. 10 is a schematic vertical sectional view taken along the line X-X of FIG. 9. In order to firmly bond the film portion 122 and the upper end portion of the damper base body 120 to each other and ensure the sealing property, the design is made so that a bonding area between the film portion 122 and the damper base body 120 is large. In this case, sink marks are generated at the time of molding of the damper base body 120, and recesses K are formed as illustrated in FIG. 10. Therefore, the film portion 122 cannot be uniformly bonded to the upper end portion of the damper base body 120. As a result, there have been problems in that the ink filled inside the recessed portion leaks out via the recesses K formed in the bonding surface, or, when the bonding strength reduces and the ink internal pressure increases, the film portion 122 peels off from the upper end surface of the damper base body 120.

SUMMARY OF THE INVENTION

The present invention has been made in view of the above-mentioned problems, and has an object to provide a pressure damper in which a flexible film, which is formed of a film or the like, and an upper surface of a damper main body are bonded firmly to each other, and which is capable of preventing peeling of the flexible film and liquid leakage to achieve high reliability.

A pressure damper according to one aspect of the present invention includes a main body portion including: an upper end portion; a recessed portion having an opening portion opened in the upper end portion; and a communication port opened in an inner surface of the recessed portion to communicate to an outer region, the upper end portion including a bank having a height larger than a height of an upper surface of the main body portion and surrounding the opening portion; and a flexible film bonded to an upper surface of the bank to close the opening portion.

Further, according to another aspect of the present invention, the bank is positioned on the opening portion side with respect to an outer periphery end of the upper end portion.

Further, according to another aspect of the present invention, the upper end portion includes: a plurality of screw holes; and screw hole portion banks provided near the plurality of screw holes, the screw hole portion banks each having a height larger than the height of the upper surface of the main body portion.

Further, according to another aspect of the present invention, the screw hole portion banks each have a radial width from an outer periphery end of each of the plurality of screw holes, the radial width not exceeding 3 mm.

Still further, according to another aspect of the present invention, the pressure damper further includes a cover, which covers the flexible film and is fixed to the upper end portion, and the cover is fixed to the main body portion with use of the plurality of screw holes.

Still further, according to another aspect of the present invention, the upper surface of the main body portion is positioned between adjacent screw hole portion banks of the screw hole portion banks.

Still further, according to another aspect of the present invention, the upper surface of the bank has a width within a range of substantially 1 mm to 3 mm.

Still further, according to another aspect of the present invention, the bank includes: a first bank surrounding the opening portion; and a second bank surrounding the first bank.

Yet further, according to another aspect of the present invention, the upper end portion includes a rib-like bank having a height larger than the height of the upper surface of the main body portion, the rib-like bank being provided from an outer periphery of the bank toward an outer periphery of the main body portion.

Yet further, according to another aspect of the present invention, the main body portion includes a protruding portion which is thinner than the main body portion and protrudes outward with respect to an outer periphery of the bank.

Yet further, according to another aspect of the present invention, the main body portion includes: a regulation plate provided between a bottom surface of the recessed portion and the flexible film; and a spring member for supporting the regulation plate.

A liquid jet head according to the present invention includes: the pressure damper according to any one of the above-mentioned aspects; and an ejection portion into which liquid is caused to flow from the pressure damper, for ejecting liquid droplets to a recording medium.

A liquid jet apparatus according to the present invention includes: the above-mentioned liquid jet head; a moving mechanism for reciprocating the liquid jet head; a liquid supply tube for supplying liquid to the liquid jet head; and a liquid tank for supplying the liquid to the liquid supply tube.

The pressure damper according to the present invention includes the main body portion including: the upper end portion; the recessed portion having the opening portion opened in the upper end portion; and the communication port opened in the inner surface of the recessed portion to communicate to the outer region, the upper end portion including the bank having the height larger than the height of the upper surface of the main body portion and surrounding the opening portion; and the flexible film bonded to the upper surface of the bank to close the opening portion. With this, the flexible film can be uniformly bonded to a flat upper surface of the bank. Thus, it is possible to provide a pressure damper with high reliability, in which the sealing property and the bonding strength are improved.

DETAILED DESCRIPTION OF THE PREFERRED EMBODIMENTS (First Embodiment)

Figure 1A:
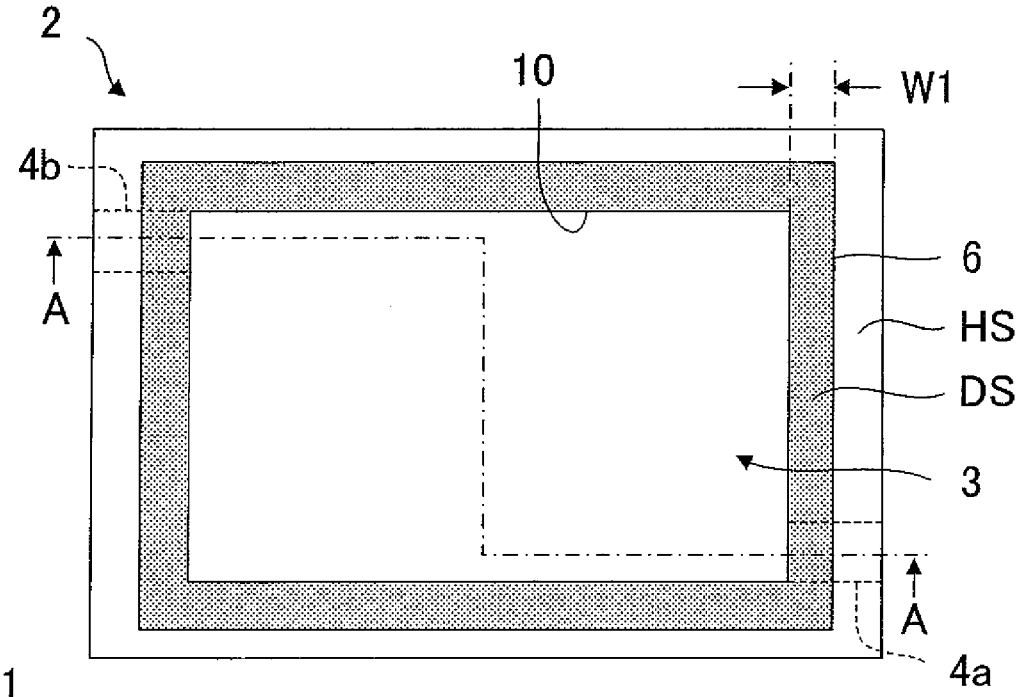
FIGS. 1A and 1B are views illustrating a pressure damper according to a first embodiment of the present invention.
Figure 1B:
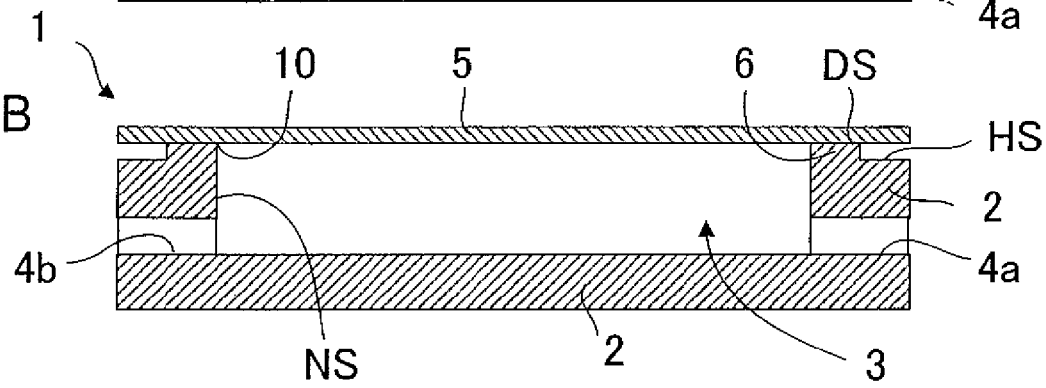

FIGS. 1A and 1B are views illustrating a pressure damper 1 according to a first embodiment of the present invention. FIG. 1A is a schematic top view of a main body portion 2 forming the pressure damper 1, and FIG. 1B is a schematic vertical sectional view taken along the line A-A of the pressure damper 1.

The pressure damper 1 includes the main body portion 2 and a flexible film 5. The main body portion 2 includes an upper end portion, a recessed portion 3 having an opening portion 10 at the upper end portion, and an in-flow communication port 4*a* and an out-flow communication port 4*b* which are opened in an inner surface NS of the recessed portion 3 to communicate to an outer region. The flexible film 5 is bonded to the upper end portion of the main body portion 2 by thermal welding to close the opening portion 10. The upper end portion of the main body portion 2 includes a bank 6 having a height larger than that of an upper surface HS of the main body portion 2 and surrounding the opening portion 10. The flexible film 5 is bonded to an upper surface DS of the bank 6. The upper surface DS of the bank 6 can be formed flat in the upper end portion of the main body portion 2, and hence the flexible film 5 and the main body portion 2 can be uniformly bonded to each other, with the result that the sealing property and the bonding strength between the flexible film 5 and the main body portion 2 are improved. Thus, the pressure damper 1 with high reliability can be formed.

Here, a synthetic resin is used for the main body portion 2 and the flexible film 5. Examples of the synthetic resin to be used include polyethylene (PE), polypropylene (PP), polyphenylene sulfide (PPS), polybutylene terephthalate (PBT), and polyethylene terephthalate (PET). The main body portion 2 is formed by molding of the synthetic resin. The flexible film 5 is bonded to the upper surface DS of the bank 6 by thermal welding. At this time, heating is performed at a temperature within a range of about 150° C. to 200° C. A width W1 of the bank 6 is preferred to fall within a range of substantially 1 mm to 3 mm. This is because, when the width W1 is formed narrower than 1 mm, the bonding area decreases and the bonding strength becomes insufficient with respect to pressure fluctuation of liquid filled inside the recessed portion 3, and when the width W1 is formed wider than 3 mm, sink marks are generated at the time of molding and a uniform bonding surface cannot be obtained.

As illustrated in FIG. 1A, the bank 6 is provided on an inner side corresponding to the opening portion 10 side with respect to an outer periphery end of the upper end portion of the main body portion 2 (side surface of the main body portion 2). That is, the main body portion 2 is provided so as to extend outside with respect to an outer periphery of the bank 6. With this, the strength of the main body portion 2 can be ensured. In particular, when the flexible film 5 is bonded to the upper end portion of the main body portion 2 by thermal welding, it is possible to prevent deformation of the main body portion 2.

Note that, the present invention is not limited to the above-mentioned arrangement of the bank 6. The outer periphery of the bank 6 may form an outer periphery of the main body portion 2 at any side or any portion. That is, there may exist a portion without the upper surface HS of the main body portion 2. The outer diameter of the main body portion 2, and the positions of the in-flow communication port 4*a* and the out-flow communication port 4*b* are not limited to those illustrated in FIG. 1.

Note that, in this embodiment, the flexible film 5 is described as a single-layer thin film, but the flexible film 5 may be a double-layer thin film (not shown). In this case, it is preferred that one layer of the two layers forming the flexible film 5 on the main body portion 2 side be made of the same resin material (for example, PE) as that for the main body portion 2, and another layer thereof not on the main body portion 2 side be made of a material having high fusibility (for example, nylon) than that of the resin material for the flexible film 5 and the main body portion 2. This structure is preferred in order to reliably weld the flexible film 5 to the main body portion 2 in manufacturing steps of thermally welding the flexible film 5 to the main body portion 2.

Specifically, in a welding step of the flexible film 5, it is preferred that, with the use of a heater block or the like, the flexible film 5 be pressed against the upper surface DS of the bank 6, and then the flexible film 5 be heated to be welded to the upper surface DS of the bank 6. At this time, when the heater block is directly pressed against the flexible film 5, there is a risk that the flexible film 5 is melted and a part of the flexible film 5 adheres to the heater block. In order to prevent this adhesion, the another layer not on the main body portion 2 side may be made of a material such as nylon, to thereby prevent adhesion of the melted flexible film 5 to the heater block.

Note that, in this embodiment, the flexible film 5 is a double-layer film, but depending on the material thereof, the flexible film 5 may be a multilayer film with more than two layers. Further, by covering an upper surface of the flexible film 5 with a nylon sheet only during welding and removing the nylon sheet after the welding, it is possible to prevent adhesion to the heater block even in the case of the single-layer flexible film 5. Note that, also in embodiments described in the following, the structure of the flexible film 5 may be the same.

(Second Embodiment)

Figure 2A:
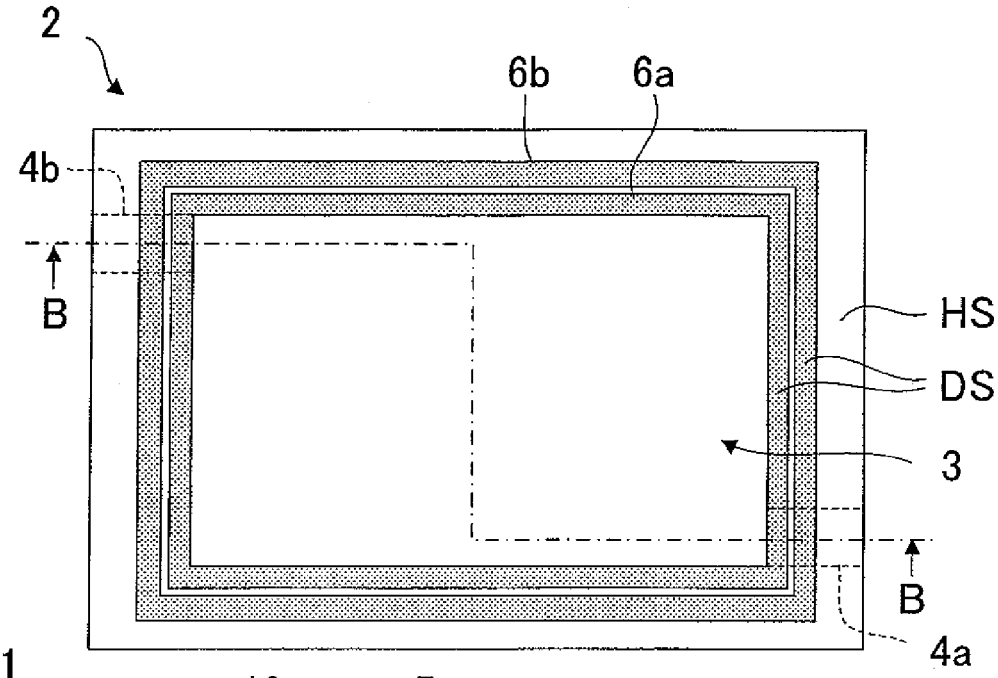
FIGS. 2A and 2B are views illustrating a pressure damper according to a second embodiment of the present invention.
Figure 2B:
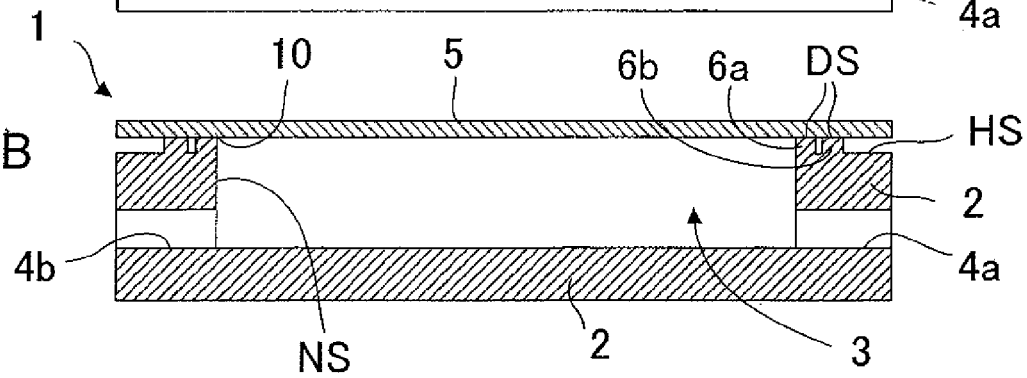

FIGS. 2A and 2B are views illustrating the pressure damper 1 according to a second embodiment of the present invention. FIG. 2A is a schematic top view of the main body portion 2 forming the pressure damper 1, and FIG. 2B is a schematic vertical sectional view taken along the line B-B of the pressure damper 1. The second embodiment differs from the first embodiment in that the bank 6 includes a first bank 6*a* and a second bank 6*b* surrounding the first bank 6*a*. Other structures are the same as those in the first embodiment. Therefore, in the following, the different portions are described. The same portions and portions having the same functions are represented by the same reference symbols.

As illustrated in FIGS. 2A and 2B, as the bank 6, a double bank including the first bank 6*a* and the second bank 6*b* is formed. The width of each of the banks 6*a* and 6*b* can be set to fall within a range of substantially 1 mm to 3 mm. With this, each of the upper surfaces DS of the first bank 6*a* and the second bank 6*b* can be formed flat, and hence the bonding area between the flexible film 5 and the main body portion 2 can be formed to be twice as large as the bonding area in a case where one bank is formed or larger. As a result, the sealing property and the bonding strength of the bonding surface of the flexible film 5 with respect to the main body portion 2 can be further improved.

(Third Embodiment)

Figure 3A:
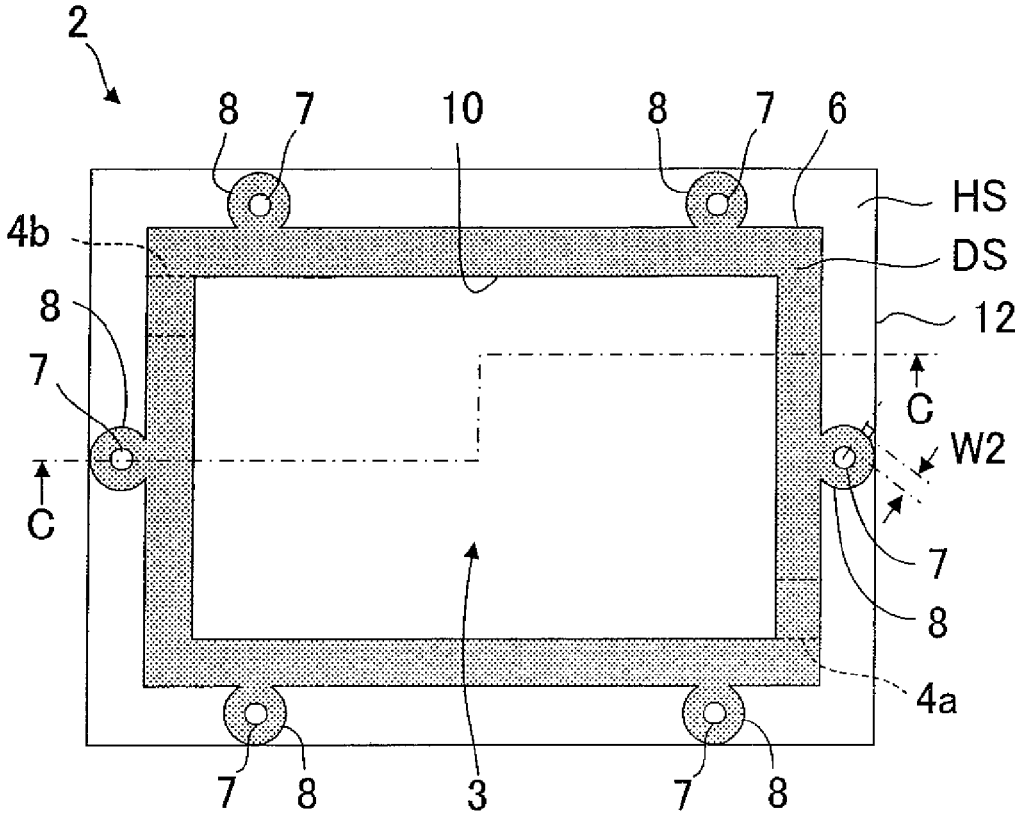
FIGS. 3A and 3B are views illustrating a pressure damper according to a third embodiment of the present invention.
Figure 3B:
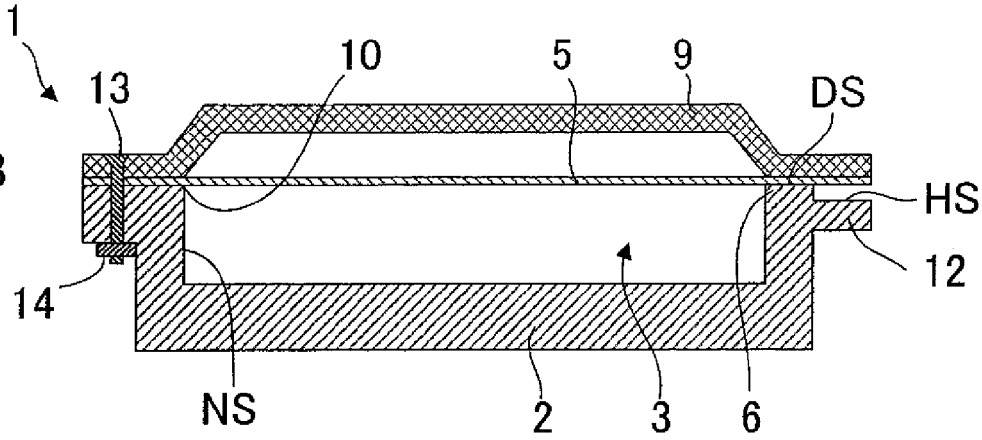

FIGS. 3A and 3B are views illustrating the pressure damper 1 according to a third embodiment of the present invention. FIG. 3A is a schematic top view of the main body portion 2 forming the pressure damper 1, and FIG. 3B is a schematic vertical sectional view taken along the line C-C of the pressure damper 1. The same portions and portions having the same functions are represented by the same reference symbols.

The pressure damper 1 includes the main body portion 2, the flexible film 5 bonded to the upper end portion of the main body portion 2, and a cover 9 fixed to an upper portion of the flexible film 5. The main body portion 2 includes the upper end portion, the recessed portion 3 opened at the upper end portion, and the in-flow communication port 4*a* and the out-flow communication port 4*b* which are opened in the inner surface NS of the recessed portion 3 to communicate with the outer region. The upper end portion of the main body portion 2 includes the bank 6 having a height larger than that of the upper surface HS of the main body portion 2 and surrounding the opening of the recessed portion 3. The upper end portion of the main body portion 2 further includes a plurality of screw holes 7 for screw mounting the cover 9, and screw hole portion banks 8 provided near the screw holes 7 and each having a height larger than that of the upper surface HS of the main body portion 2. Two screw holes 7 and two screw hole portion banks 8 provided near the screw holes 7 are formed in each of upper and lower sides of the bank 6 outside the outer periphery thereof, and one screw hole 7 and one screw hole portion bank 8 are formed in each of right and left sides of the bank 6 outside the outer periphery thereof.

The flexible film 5 is bonded to the upper surface DS of the bank 6 and upper surfaces of the screw hole portion banks 8. The cover 9 has a recess recessed upward in a region corresponding to the recessed portion 3, to thereby limit the upward displacement of the flexible film 5 and prevent breakage of the flexible film 5 due to the pressure of the liquid. The cover 9 is fixed to the main body portion 2 through the intermediation of the flexible film 5 by screws 13 inserted through the screw holes 7 and nuts 14 provided on the main body portion 2 side. As described above, the screw hole portion banks 8 are formed near the screw holes 7, and thus the flexible film 5 can be uniformly pressed against the upper surface DS of the bank 6. In this manner, it is possible to improve the bonding strength between the flexible film 5 and the main body portion 2, and further improve the sealing property between the flexible film 5 and the main body portion 2.

Note that, the screw hole portion banks 8 formed near the screw holes 7 are desired to be formed so that each radial width W2 from an outer periphery end of the screw hole 7 does not exceed 3 mm. With this, similarly to the upper surface DS of the bank 6, the upper surfaces DS of the screw hole portion banks 8 can be formed flat without sink marks. This is because, when the width W2 exceeds 3 mm, the sink marks are liable to be generated on the upper surfaces of the screw hole portion banks 8, which leads to reduction in flatness and causes non-uniform bonding with the flexible film 5.

The main body portion 2 includes a protruding portion 12, which is thinner than the main body portion 2 and protrudes outside with respect to the outer periphery of the bank 6. An upper surface of the protruding portion 12 forms the upper surface HS of the main body portion 2, and a lower part of the protruding portion 12 has a cutout. With this, the strength of the main body portion 2 is improved, and further, weight increase of the pressure damper 1 can be suppressed. Note that, in FIG. 3, the protruding portion 12 is provided between all of the adjacent screw holes 7, but the present invention is not limited thereto. That is, the protruding portion 12 may be provided only at any side or any portion, and in other portions, the outer surface of the bank 6 and the outer surface of the main body portion 2 may be formed flush, or the main body portion 2 without a cutout may be provided outside the outer periphery of the bank 6.

(Fourth Embodiment)

Figure 4:
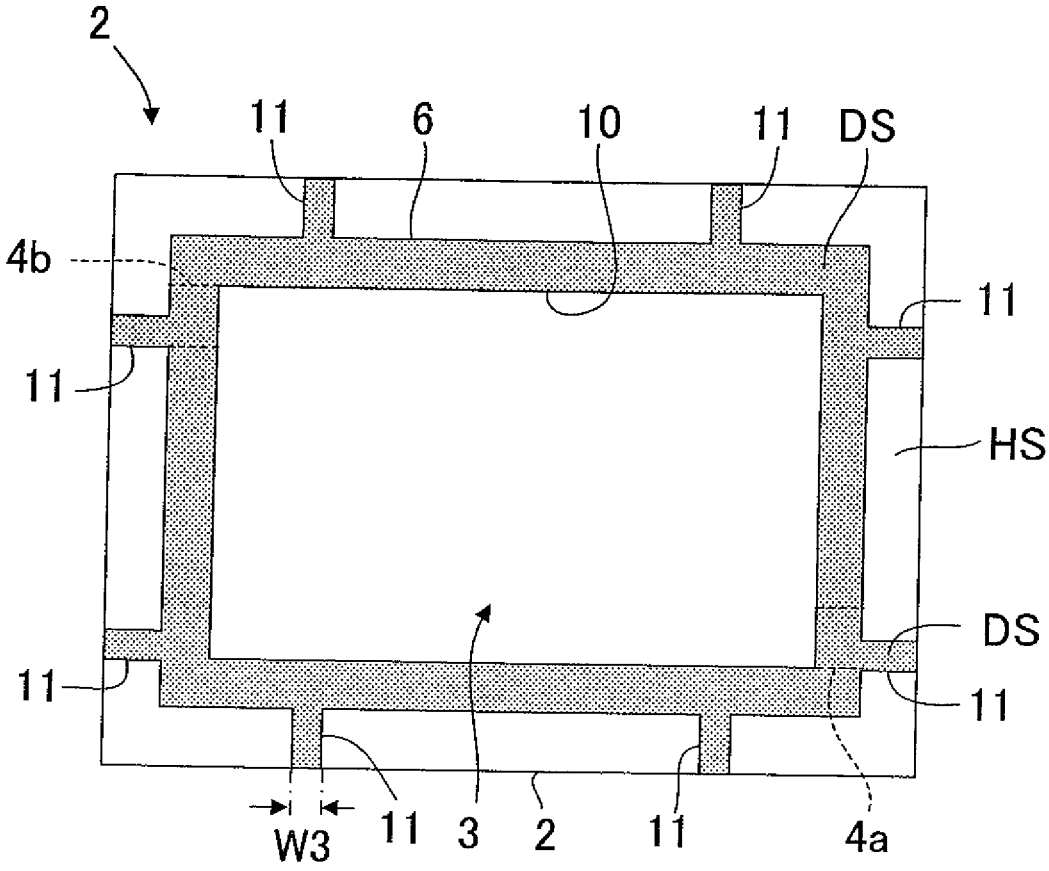
FIG. 4 is a schematic top view of a main body portion of a pressure damper according to a fourth embodiment of the present invention.

FIG. 4 is a schematic top view of the main body portion 2 of the pressure damper 1 according to a fourth embodiment of the present invention. The fourth embodiment differs from the first embodiment in that the upper end portion of the main body portion 2 includes rib-like banks 11 radially provided from the outer periphery of the bank 6. Other points are the same as those in the first embodiment. Therefore, in the following, the different portions are described. The same portions and portions having the same functions are represented by the same reference symbols.

As illustrated in FIG. 4, the upper end portion of the main body portion 2 includes the rib-like banks 11, each having a height larger than that of the upper surface HS of the main body portion 2 and extending from the outer periphery of the bank 6 to the outer periphery of the main body portion 2. Two rib-like banks 11 are formed in each of the upper and lower sides of the bank 6, and two rib-like banks 11 are formed in each of the right and left sides thereof. A width W3 of each of the rib-like banks 11 is preferred to be formed so as not to exceed 3 mm. This is because, when the width W3 exceeds 3 mm, due to the same reason as the bank 6, the sink marks are liable to be generated, and the flatness of the upper surface is reduced. The flexible film 5 is bonded to the upper surfaces DS of the rib-like banks 11 as well as the upper surface DS of the bank 6 by thermal welding, and hence the bonding strength is improved. Note that, the provision places and the number of the rib-like banks 11 may be set as necessary.

(Fifth Embodiment)

Figure 5A:
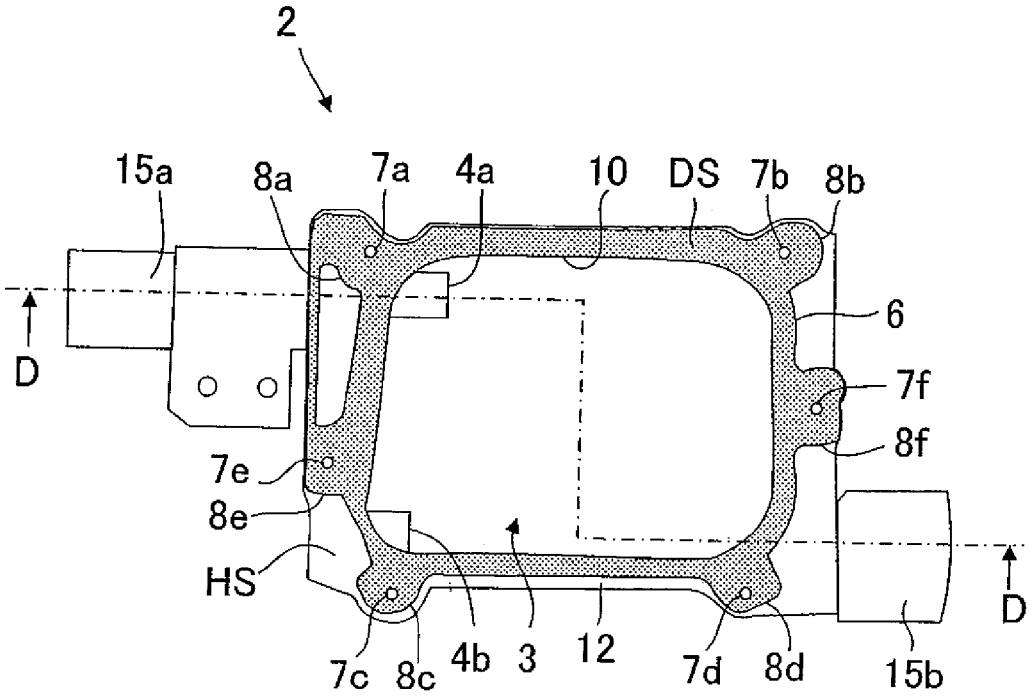
FIGS. 5A and 5B are views illustrating a pressure damper according to a fifth embodiment of the present invention.
Figure 5B:
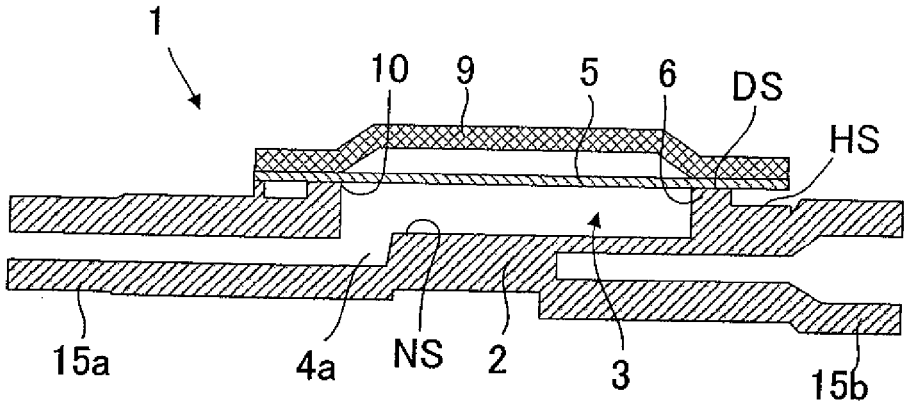

FIGS. 5A and 5B are views illustrating the pressure damper 1 according to a fifth embodiment of the present invention. FIG. 5A is a schematic top view of the main body portion 2, and FIG. 5B is a schematic vertical sectional view taken along the line D-D of the pressure damper 1. The same portions and portions having the same functions are represented by the same reference symbols.

As illustrated in FIGS. 5A and 5B, the main body portion 2 has a substantially quadrangular flattened shape, and includes the upper end portion, the recessed portion 3 at the center of the upper end portion, an in-flow connection portion 15*a* provided on the left side thereof, for causing liquid to flow in, and an out-flow connection portion 15*b* provided on the right side thereof, for causing liquid to flow out. The recessed portion 3 includes the opening portion 10 opened at the upper end portion of the main body portion 2. At a corner portion between the left side and the upper side of a bottom surface corresponding to the inner surface of the recessed portion 3, the in-flow communication port 4*a* is opened so as to be communicated to the in-flow connection portion 15*a*. At a corner portion between the left side and the lower side of the bottom surface, the out-flow communication port 4*b* is opened so as to be communicated to the out-flow connection portion 15*b*. The out-flow communication port 4*b* is formed on the left side with respect to the in-flow communication port 4*a* so as to prevent air bubbles from remaining when the liquid is filled inside the recessed portion 3 because the pressure damper 1 is used under a state in which the in-flow connection portion 15*a* side is arranged higher than the out-flow connection portion 15*b* side in the gravity direction.

The upper end portion of the main body portion 2 includes the bank 6 having a height larger than that of the upper surface HS of the main body portion 2 and surrounding the opening portion 10. The upper end portion of the main body portion 2 further includes screw holes 7*a* to 7*f* for screw mounting. Near the respective screw holes 7*a* to 7*f*, screw hole portion banks 8*a* to 8*f* each having a height larger than that of the upper surface HS of the main body portion 2 are correspondingly formed. The center of each of the screw holes 7*a* to 7*f* is positioned on the outer periphery side of the main body portion 2 with respect to the outer periphery of the bank 6. The screw holes 7*a*, 7*b*, 7*c*, and 7*d* are formed at corners of the respective sides of the main body portion 2, and the screw holes 7*e* and 7*f* are formed at substantially the centers of the respective right and left sides of the main body portion 2. The respective screw hole portion banks 8*a* to 8*f* provided near the screw holes 7*a* to 7*f* and the bank 6 surrounding the opening portion 10 are continuously formed. Therefore, the upper surfaces of the respective banks are formed continuously and flush.

The flexible film 5 is bonded to the bank 6 and the respective upper surfaces DS of the screw hole portion banks 8 to close the opening portion 10. The cover 9 is mounted by being screwed into the screw holes 7*a* to 7*f* of the main body portion 2 while sandwiching the flexible film 5, to thereby prevent expansion and breakage of the flexible film 5. In this case, the upper surface of the bank 6 and the upper surfaces of the screw hole portion banks 8 are formed continuously and flush, and hence the bonding property of the flexible film 5 with respect to the upper surfaces DS is improved. Further, the cover 9 is screw mounted to the main body portion 2, and hence a bottom surface of the cover 9 on the outer periphery side uniformly presses the surface of the flexible film 5. In this manner, the bonding strength and the sealing property between the flexible film 5 and the main body portion 2 are further improved.

Note that, in this embodiment, between the screw hole portion bank 8*a* and the screw hole portion bank 8*b* formed in the upper side of the upper end portion, the outer periphery end of the bank 6 substantially matches with the outer periphery end of the main body portion 2. Meanwhile, between the screw hole portion bank 8*c* and the screw hole portion bank 8*d* formed in the lower side of the upper end portion, the protruding portion 12 protruding outward with respect to the outer periphery end of the bank 6 is provided. The width of the bank 6 in the lower side is smaller than the width of the bank 6 in the upper side, and hence the protruding portion 12 is provided to ensure the strength of the main body portion 2. As described above, by providing the protruding portion 12 at necessary portions, the strength of the main body portion 2 can be ensured. Further, by forming a cutout in the lower portion of the protruding portion 12, the weight increase of the pressure damper 1 can be suppressed.

(Sixth Embodiment)

Figure 6:
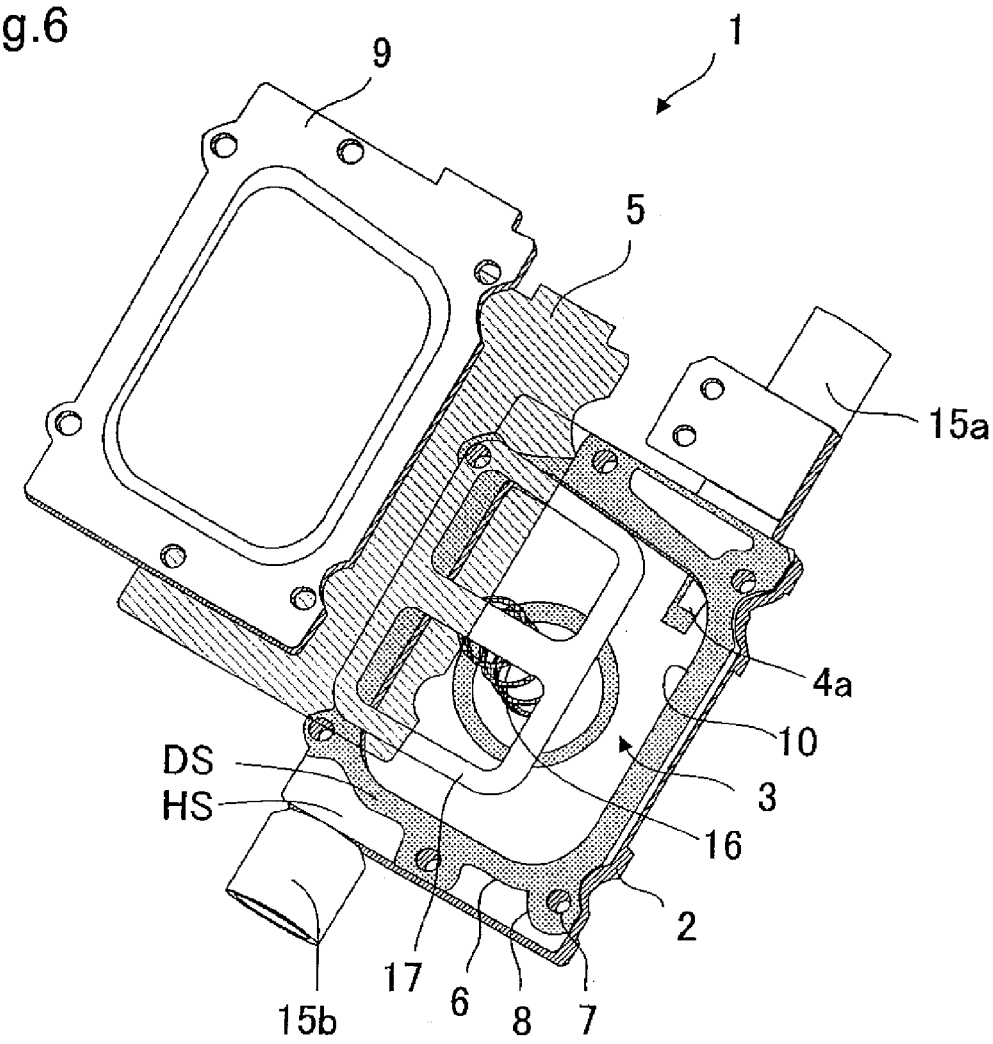
FIG. 6 is a schematic exploded perspective view illustrating a pressure damper according to a sixth embodiment of the present invention.

FIG. 6 is a schematic exploded perspective view of the pressure damper 1 according to a sixth embodiment of the present invention. The sixth embodiment differs from the fifth embodiment in that a spring member 16 and a regulation plate 17 are provided between the flexible film 5 and the bottom surface of the recessed portion 3. Other points are the same as those in the fifth embodiment. Therefore, in the following, the different portions are mainly described, and description of the same portions is omitted. The same portions and portions having the same functions are represented by the same reference symbols. Note that, the regulation plate 17 may be also formed in other embodiments.

The pressure damper 1 includes a lamination structure of the main body portion 2, the flexible film 5, and the cover 9. The flexible film 5 is bonded to the bank 6 formed in the upper end portion of the main body portion 2 and the upper surfaces DS of the screw hole portion banks 8 formed near the respective screw holes 7. The cover 9 is mounted by being screwed into the screw holes 7 of the main body portion 2. Then, between the flexible film 5 and the bottom surface of the recessed portion 3, the regulation plate 17 and the spring member 16 for supporting the regulation plate 17 are provided. With this, it is possible to prevent a phenomenon that, when the liquid filled inside the recessed portion 3 is provided with strong negative pressure, the flexible film 5 is pulled toward the recessed portion 3, to thereby close the in-flow communication port 4*a* or the out-flow communication port 4*b* (see FIGS. 5A and 5B). Other actions and effects are the same as those in the third embodiment and the fifth embodiment.

(Seventh Embodiment)

Figure 7:
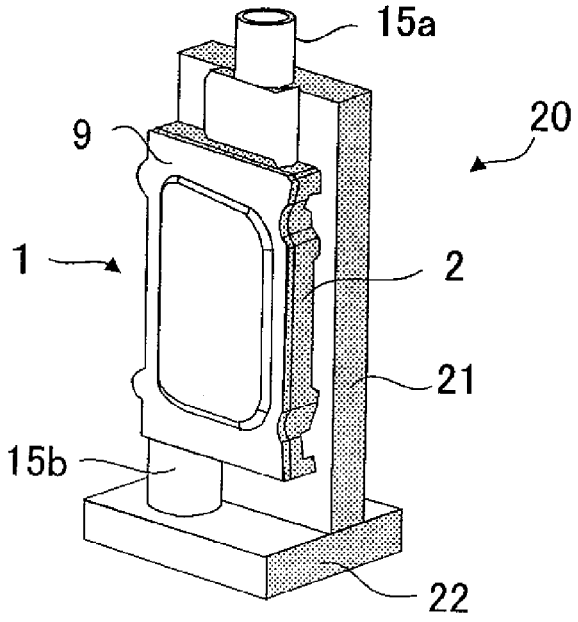
FIG. 7 is a schematic perspective view of a liquid jet head according to a seventh embodiment of the present invention.

FIG. 7 is a schematic perspective view of a liquid jet head 20 according to a seventh embodiment of the present invention. FIG. 7 illustrates a state in which the pressure damper 1 described in the fifth or sixth embodiment is provided to the liquid jet head 20. As illustrated in FIG. 7, the liquid jet head 20 includes a base 21, an ejection portion 22 for ejecting liquid droplets to a recording medium (not shown), the pressure damper 1 for supplying liquid to the ejection portion 22, and a control circuit board (not shown) having a control circuit for controlling the ejection portion 22 mounted thereon.

The ejection portion 22 includes an actuator for ejecting liquid droplets in response to a drive signal, and a flexible circuit board for electrically connecting the actuator and the control circuit board to each other. The base 21 has a screen shape, and the ejection portion 22 is mounted on a bottom portion thereof and the control circuit board (not shown) and the pressure damper 1 are fixed onto a side surface thereof. The pressure damper 1 is fixed to the base 21 under a state in which the cover 9 is positioned outside and the main body portion 2 is positioned on the base 21 side. Liquid flows into the recessed portion of the main body portion 2 from a pipe (not shown) via the in-flow connection portion 15*a*, and flows out to the ejection portion 22 via the out-flow connection portion 15*b*. The actuator of the ejection portion 22 ejects liquid droplets to the recording medium from nozzles (not shown) provided on the lower side thereof in response to the drive signal from the control circuit.

(Eighth Embodiment)

Figure 8:
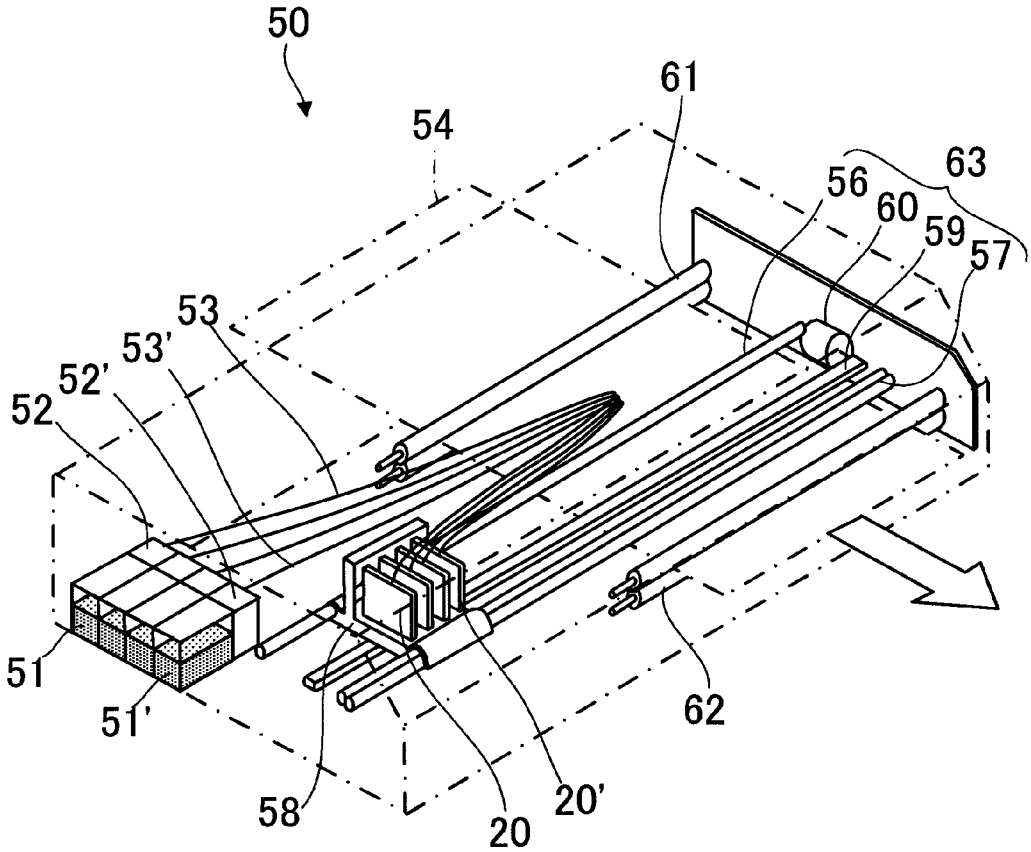
FIG. 8 is a schematic perspective view of a liquid jet apparatus according to an eighth embodiment of the present invention.
Figure 9:
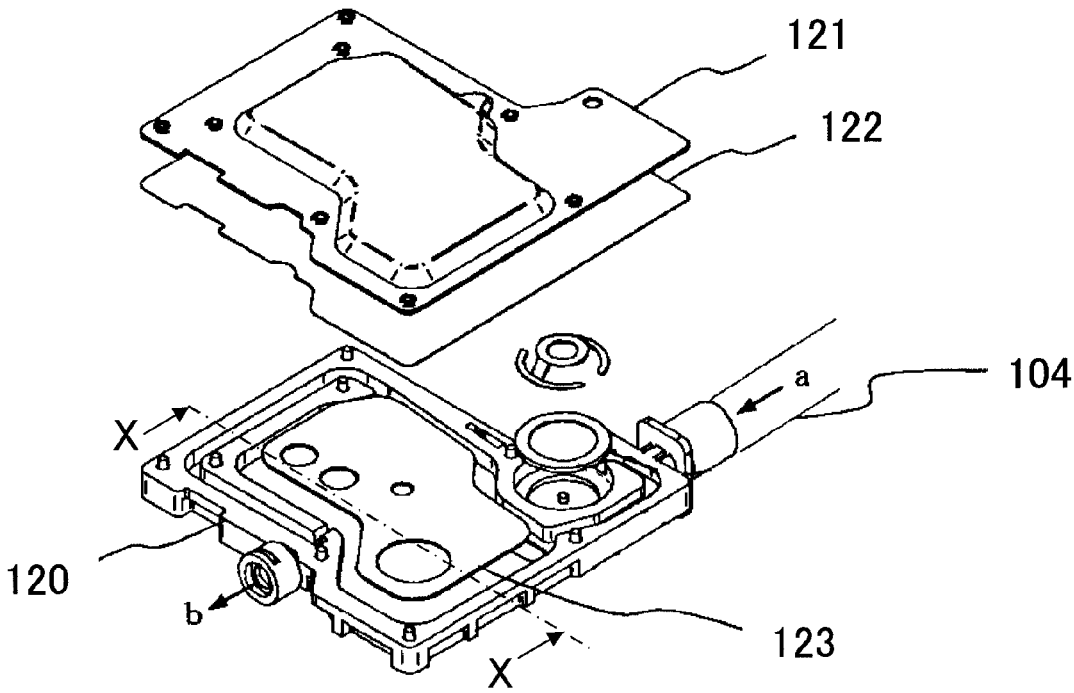
Fig.9 Prior Art
FIG. 9 is an exploded perspective view of a conventionally well-known damper.
Figure 10:
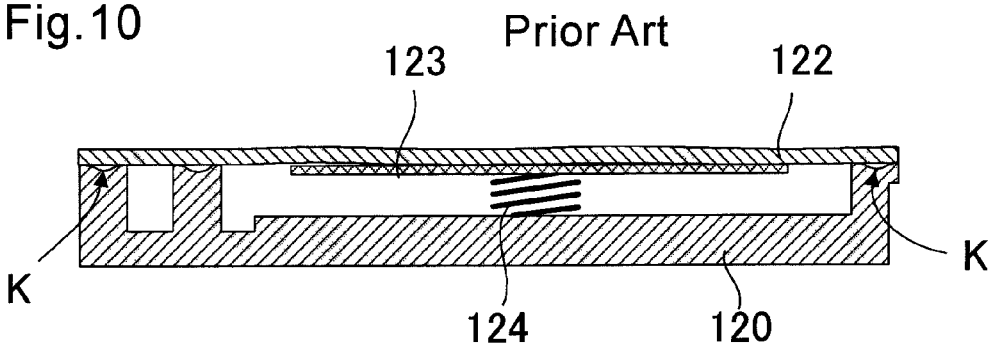
FIG. 10 is a schematic sectional view of the conventionally well-known damper.

FIG. 8 is a schematic perspective view of a liquid jet apparatus 50 according to an eighth embodiment of the present invention. The liquid jet apparatus 50 uses the liquid jet head 20 described in the seventh embodiment above. The liquid jet apparatus 50 includes a moving mechanism 63 for reciprocating liquid jet heads 20 and 20', liquid supply tubes 53 and 53' for supplying liquid to the liquid jet heads 20 and 20', respectively, and liquid tanks 51 and 51' for supplying the liquid to the liquid supply tubes 53 and 53', respectively. The liquid jet heads 20 and 20' each include an actuator for ejecting the liquid, a flow path member for supplying the liquid to the actuator, and the pressure damper 1 for supplying the liquid to the flow path member.

Specific description is given below. The liquid jet apparatus 50 includes a pair of transport means 61 and 62 for transporting a recording medium 54 such as paper in a main scanning direction, the liquid jet heads 20 and 20' for ejecting the liquid onto the recording medium 54, pumps 52 and 52' for pressing the liquid stored in the liquid tanks 51 and 51' to supply the liquid to the liquid supply tubes 53 and 53', respectively, and the moving mechanism 63 for moving the liquid jet heads 20 and 20' to perform scanning in a sub-scanning direction orthogonal to the main scanning direction.

The pair of transport means 61 and 62 each extend in the sub-scanning direction, and include a grid roller and a pinch roller that rotate with their roller surfaces coming into contact with each other. The grid roller and the pinch roller are rotated about their shafts by means of a motor (not shown) to transport the recording medium 54 sandwiched between the rollers in the main scanning direction. The moving mechanism 63 includes a pair of guide rails 56 and 57 extending in the sub-scanning direction, a carriage unit 58 capable of sliding along the pair of guide rails 56 and 57, an endless belt 59 to which the carriage unit 58 is connected for moving the carriage unit 58 in the sub-scanning direction, and a motor 60 for revolving the endless belt 59 through pulleys (not shown).

The carriage unit 58 has the plurality of liquid jet heads 20 and 20' placed thereon, and ejects liquid droplets of four types, for example, yellow, magenta, cyan, and black. The liquid tanks 51 and 51' store liquid of corresponding colors, and supply the liquid through the pumps 52 and 52' and the liquid supply tubes 53 and 53' to the liquid jet heads 20 and 20', respectively. A control portion of the liquid jet apparatus 50 sends a drive signal to the liquid jet heads 20 and 20' to cause the liquid jet heads 20 and 20' to eject the liquid droplets of the respective colors. The control portion controls the timing to eject the liquid from the liquid jet heads 20 and 20', the rotation of the motor 60 for driving the carriage unit 58, and the transport speed of the recording medium 54, to thereby record an arbitrary pattern onto the recording medium 54.

In this embodiment, the flexible film 5 of the pressure damper 1 is bonded to the bank 6, which is formed in the upper end portion of the main body portion 2, and the upper surfaces DS of the screw hole portion banks 8, and hence it is possible to provide a liquid jet apparatus with high reliability, in which the bonding strength between the flexible film 5 and the main body portion 2 is improved and the sealing property between the flexible film 5 and the main body portion 2 is improved.

(Ninth Embodiment)

Figure 11A:
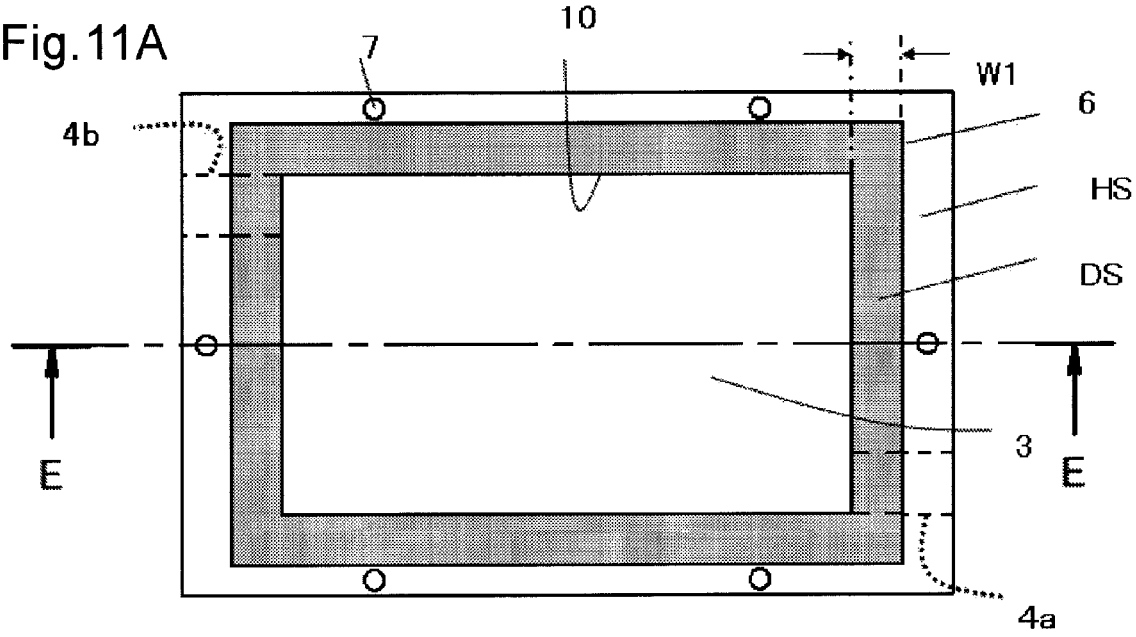
FIGS. 11A and 11B are views illustrating a pressure damper according to a ninth embodiment of the present invention.
Figure 11B:
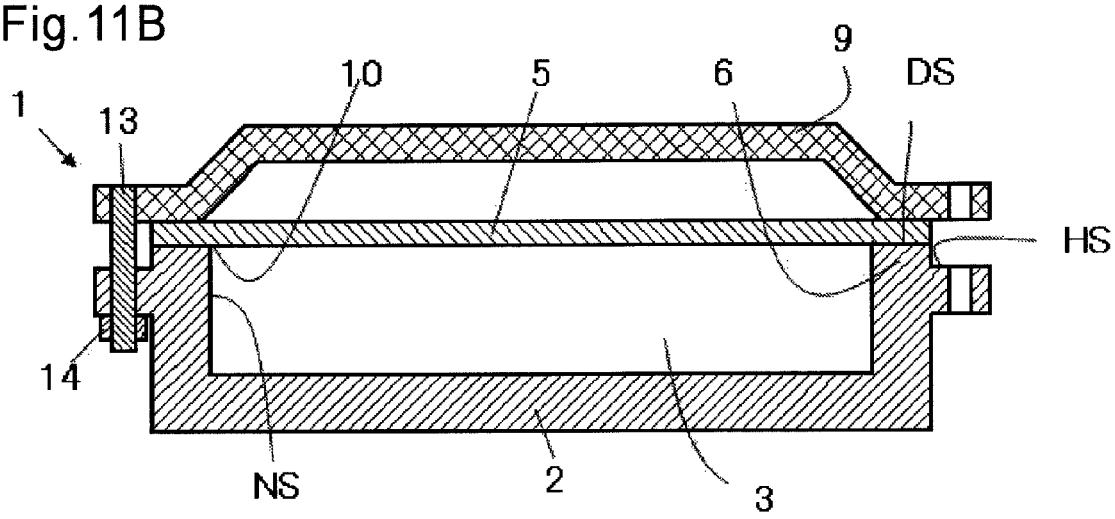

FIGS. 11A and 11B are views illustrating the pressure damper 1 according to a ninth embodiment of the present invention. FIG. 11A is a schematic top view of the main body portion 2 forming the pressure damper 1, and FIG. 11B is a schematic vertical sectional view taken along the line E-E of the pressure damper 1. Note that, this embodiment is obtained by providing the cover 9 to the first embodiment and adding the screw holes 7 for fixing the cover 9. The same portions and portions having the same functions are represented by the same reference symbols.

The pressure damper 1 includes the main body portion 2, the flexible film 5 bonded to the upper end portion of the main body portion 2, and the cover 9 fixed to the upper portion of the flexible film 5. The main body portion 2 includes, as illustrated in FIG. 11A, the same bank 6 as that in the first embodiment, and the plurality of screw holes 7 for screw mounting the cover 9 to the upper surface HS of the main body portion 2.

As illustrated in FIG. 11B, the flexible film 5 is bonded to the upper surface DS of the bank 6. The cover 9 has a recess recessed upward in a region corresponding to the recessed portion 3, to thereby limit the upward displacement of the flexible film 5 and prevent breakage of the flexible film 5 due to the pressure of the liquid.

Further, in this embodiment, when the flexible film 5 is thermally welded to the main body portion 2, there is a possibility that the upper surface DS melted by heat extends in a direction parallel to the flexible film 5 to extend off in the periphery of the upper surface DS corresponding to the edge of the main body portion 2, to thereby form melting burrs. In this embodiment, the screw holes 7, which have a shape in which the melting burrs are liable to be aggregated, and to which large stress is applied as compared to the periphery thereof, are provided in the upper surface HS of the main body portion 2, which is a surface not to be subjected to thermal welding. In this manner, the screw holes 7 are not thermally welded and the melting burrs are not formed in the screw holes 7. Therefore, it is possible to prevent cracks from the screw holes 7. In other words, the screw holes 7 are formed outside the bank 6 surrounding the opening portion 10 as screw holes for screw mounting.

(Tenth Embodiment)

Figure 12A:
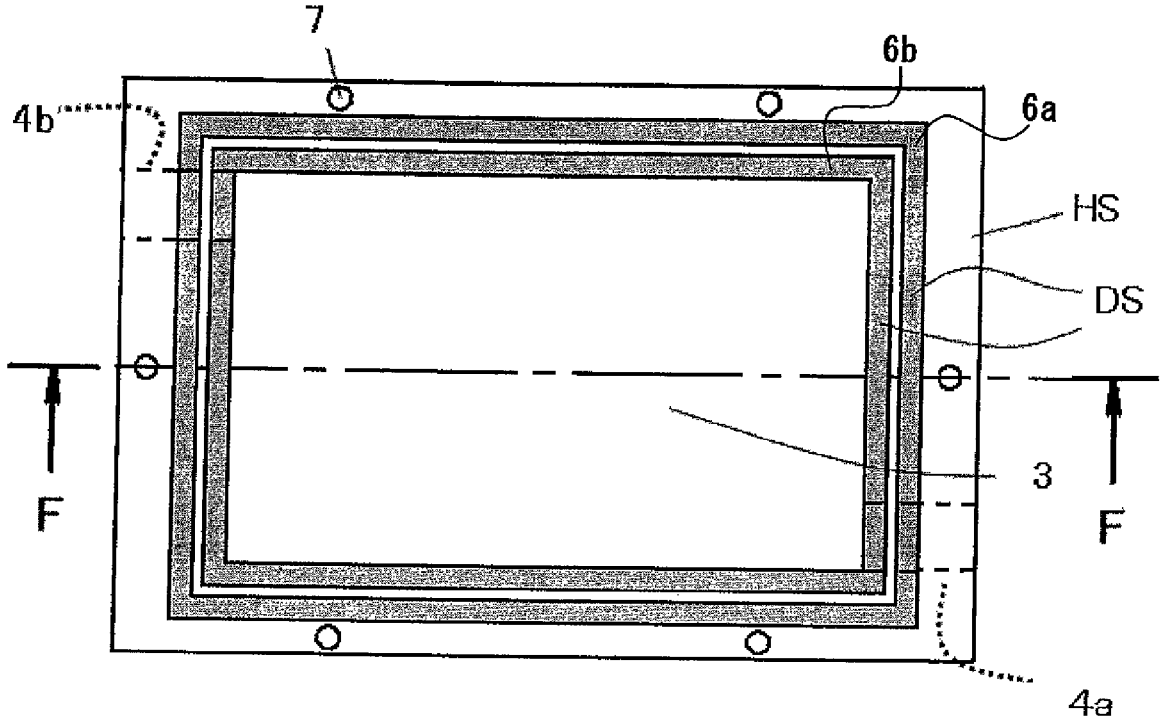
FIGS. 12A and 12B are views illustrating a pressure damper according to a tenth embodiment of the present invention.
Figure 12B:
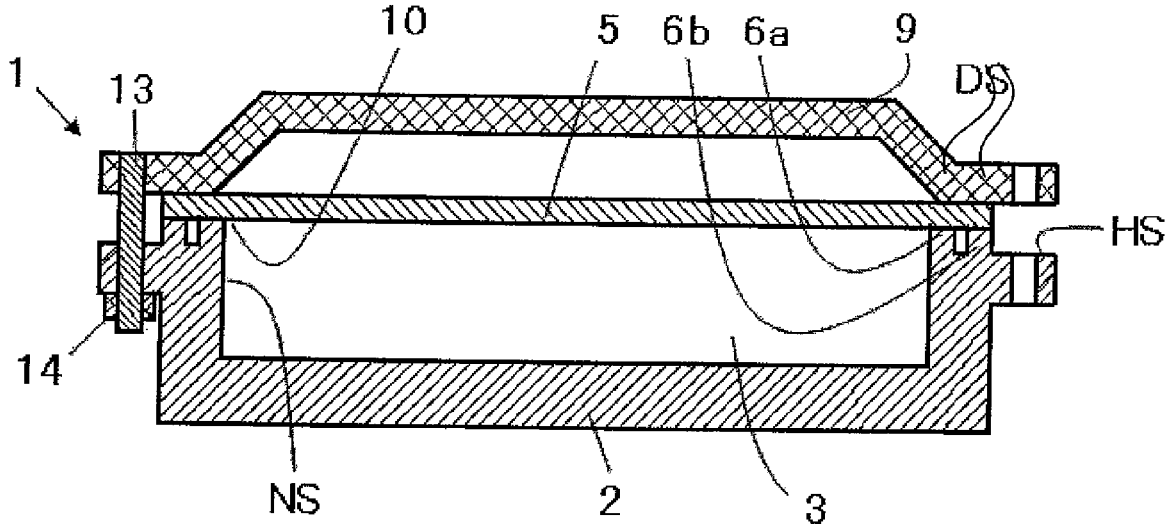

FIGS. 12A and 12B are views illustrating the pressure damper 1 according to a tenth embodiment of the present invention. FIG. 12A is a schematic top view of the main body portion 2 forming the pressure damper 1, and FIG. 12B is a schematic vertical sectional view taken along the line F-F of the pressure damper 1. Note that, this embodiment is obtained by providing the cover 9 to the second embodiment and adding the screw holes 7 for fixing the cover 9. The same portions and portions having the same functions are represented by the same reference symbols.

The pressure damper 1 includes the main body portion 2, the flexible film 5 bonded to the upper end portion of the main body portion 2, and the cover 9 fixed to the upper portion of the flexible film 5. The main body portion 2 includes, as illustrated in FIG. 12A, the same banks 6*a* and 6*b* as those in the second embodiment, and the plurality of screw holes 7 for screw mounting the cover 9 to the upper surface HS of the main body portion 2. Note that, in FIGS. 12A and 12B, the screw holes 7 are provided at the outer periphery of the bank 6*b*, but may be alternatively provided between the bank 6*a* and the bank 6*b*.

As illustrated in FIG. 12B, the flexible film 5 is bonded to the upper surface DS of the bank 6. The cover 9 has a recess recessed upward in a region corresponding to the recessed portion 3, to thereby limit the upward displacement of the flexible film 5 and prevent breakage of the flexible film 5 due to the pressure of the liquid.

In this embodiment, as in the ninth embodiment, the screw holes 7, which have a shape in which the melting burrs are liable to be aggregated, and to which large stress is applied as compared to the periphery thereof, are provided in the upper surface HS of the main body portion 2, which is a surface not to be subjected to thermal welding. In this manner, the screw holes 7 are not thermally welded and the melting burrs are not formed in the screw holes 7. Therefore, it is possible to prevent cracks from the screw holes 7.

What is claimed is:

1. A pressure damper, comprising:

a main body portion having upper end portion, a recessed portion having an opening portion opened in the upper end portion, and a communication port opened in an inner surface of the recessed portion to communicate with an outer region of the pressure damper, the upper end portion comprising a at least one bank having a height larger than a height of an upper surface of the main body portion and surrounding the opening portion and having a width smaller than a width of a side wall of the main body portion; and a flexible film bonded to an upper surface of the bank to close the opening portion.

2. A pressure damper according to claim 1, wherein the upper end portion of the main body comprises:

a plurality of screw holes; and a plurality of screw hole portion banks provided near respective ones of the plurality of screw holes, each of the screw hole portion banks having a height larger than the height of the upper surface of the main body portion.

3. A pressure damper according to claim 2, wherein the plurality of screw hole portion banks are radially spaced at a radial width from outer periphery ends of respective ones of the plurality of screw holes, the radial width not exceeding 3 mm.

4. A pressure damper according to claim 2, further comprising a cover that covers the flexible film and that is fixed to the upper end portion, the cover being fixed to the main body portion via the plurality of screw holes.

5. A pressure damper according to claim 1, further comprising a cover that covers the flexible film and that is fixedly mounted to the upper end portion; wherein the upper surface of the main body portion comprises a plurality of screw holes for screw mounting, the cover being mounted by being screwed into the plurality of screw holes.

6. A pressure damper according to claim 1, wherein the upper surface of the bank has a width within a range of substantially 1 mm to 3 mm.

7. A pressure damper according to claim 1, wherein the at least one bank comprises:

a first bank surrounding the opening portion; and a second bank surrounding the first bank.

8. A pressure damper according to claim 1, wherein the upper end portion of the main body comprises a rib-like bank having a height larger than the height of the upper surface of the main body portion, the rib-like bank being provided from an outer periphery of the bank toward an outer periphery of the main body portion.

9. A pressure damper according to claim 1, wherein the main body portion includes a protruding portion which is thinner than the main body portion and protrudes outward with respect to an outer periphery of the at least one bank.

10. A pressure damper according to claim 1, wherein the main body portion comprises:

a regulation plate provided between a bottom surface of the recessed portion and the flexible film; and a spring member for supporting the regulation plate.

11. A liquid jet head, comprising:

a pressure damper comprised of a main body portion and a flexible film, the main body portion having upper end portion, a recessed portion having an opening portion opened in the upper end portion, and a communication port opened in an inner surface of the recessed portion to communicate with an outer region of the pressure damper, the upper end portion comprising at least one bank having a height larger than a height of an upper surface of the main body portion and surrounding the opening portion and having a width smaller than a width of a side wall of the main body portion, the flexible film being bonded to an upper surface of the bank to close the opening portion; and an ejection portion into which liquid is caused to flow from the pressure damper, for ejecting liquid droplets to a recording medium.

12. A liquid jet apparatus, comprising:

a liquid jet head comprising: a pressure damper comprised of a main body portion and a flexible film, the main body portion having upper end portion, a recessed portion having an opening portion opened in the upper end portion, and a communication port opened in an inner surface of the recessed portion to communicate with an outer region of the pressure damper, the upper end portion comprising at least one bank having a height larger than a height of an upper surface of the main body portion and surrounding the opening portion and having a width smaller than a width of a side wall of the main body portion, the flexible film being bonded to an upper surface of the bank to close the opening portion; and an ejection portion into which liquid is caused to flow from the pressure damper, for ejecting liquid droplets to a recording medium;

a moving mechanism for reciprocating the liquid jet head;

a liquid supply tube for supplying liquid to the liquid jet head; and a liquid tank for supplying the liquid to the liquid supply tube.

13. A pressure damper, comprising:

a main body comprised of a first portion having a first width, at least one second portion integral with and extending from an upper surface of the first portion and having a second width smaller than the first width, a recessed portion having an opening that opens from an upper end of the main body and that is surrounded by the at least one first portion, and a communication port communicating the recessed portion with an exterior of the main body; and a flexible film bonded to an upper surface of the at least one second portion of the main body to close the opening portion.

14. A pressure damper according claim 13, wherein the upper surface of the second portion has a width in the range of about 1 mm to about 3 mm.

15. A pressure damper according to claim 13; wherein the at least one second portion comprises a pair of second portions integral with the first portion and each having the second width, one of the second portions directly surrounding the opening portion of the main body and the other of the second portions surrounding the one second portion.

16. A pressure damper according to claim 13; further comprising a cover mounted on the at least one second portion via the flexible film.

17. A pressure damper according to claim 13; wherein the main body further comprises a protruding portion extending from the at least one second portion in a direction away from an outer periphery of the main body, an upper surface of the protruding portion corresponding to the upper surface of the first portion.

18. A pressure damper according to claim 13; wherein the main body further comprises a regulation plate and a spring member that supports the regulation plate, the regulation plate and the spring member being provided between the flexible film and a bottom surface of the recessed portion.

* * * * *